US005252780A

United States Patent [19]

Ramos et al.

[11] Patent Number: 5,252,780

[45] Date of Patent: Oct. 12, 1993

[54] SUPPORT ARRANGEMENT FOR A ROTATABLE INSULATOR

[75] Inventors: Joel A. Ramos, Chicago; Leonard V. Chabala, Maywood; Peter J. Meyer, Chicago; Thomas J. Tobin, Northbrook, all of Ill.

[73] Assignee: S&C Electric Company, Chicago, Ill.

[21] Appl. No.: 590,727

[22] Filed: Oct. 1, 1990

Related U.S. Application Data

[63] Continuation-in-part of Ser. No. 331,216, Mar. 30, 1989, and a continuation-in-part of Ser. No. 487,356, Mar. 1, 1990.

[51] Int. Cl.[5] ..... H01B 17/16

[52] U.S. Cl. ..... 174/161 R; 174/158 R; 384/297

[58] Field of Search ..... 174/158 R, 161 R; 200/48 R, 48 P, 48 A, 48 SB, 48 CB, 144 B; 384/296, 297, 299, 300, 906, 907, 908, 909, 911

[56] References Cited

U.S. PATENT DOCUMENTS

| | | | |
|---|---|---|---|
| 2,790,024 | 6/1952 | Fulmer | 174/161 R |
| 4,134,175 | 1/1979 | Contoyanis | 384/296 X |
| 4,932,795 | 6/1990 | Guinn | 384/297 X |
| 4,951,599 | 8/1990 | Damji | 384/909 X |
| 4,962,289 | 10/1990 | Stegmüler | 200/144 B |
| 4,983,792 | 1/1991 | Rogers et al. | 200/148 R X |

*Primary Examiner*—Leo P. Picard
*Assistant Examiner*—Trinidad Korka
*Attorney, Agent, or Firm*—James V. Lapacek

[57] ABSTRACT

A durable polymeric bearing is provided for a rotatable support insulator. The bearing is of sufficient conductivity to permit the flow of leakage current and capacitive charging current through the bearing. Thus, tracking across and/or deterioration of the bearing is avoided since insufficient voltage is developed across the bearing to cause any deleterious effects.

10 Claims, 1 Drawing Sheet

SUPPORT ARRANGEMENT FOR A ROTATABLE INSULATOR

CROSS-REFERENCE TO RELATED APPLICATION

This application is a continuation-in-part application of commonly assigned copending U.S. application Ser. Nos. 07/331,216 filed in the names of Rogers et al on Mar. 30, 1989 and 07/487,356 filed in the names of Ramos et al on Mar. 1, 1990.

BACKGROUND OF THE INVENTION

1. Field of the Invention

The present invention relates generally to the field of insulators and switches, and more particularly to a support arrangement for an insulator including a non-metallic element of suitable conductivity to permit the flow of leakage current as well as capacitive charging current through the element.

2. Description of the Related Art

Various rotatable insulators and insulating support columns are known in the field of electrical power distribution and transmission. For example, see U.S. Pat. Nos. 4,596,906 and 4,752,859 and co-pending application Ser. No. 07/331,216 now U.S. Pat. No. 4,983,792.

In such arrangements, the top of the insulator carries a conductor at one potential and the bottom of the insulator is rotatably supported with respect to a support surface at a second potential. Even where the insulator is fabricated from a polymeric material, it is desirable to provide a low friction interface between the insulator and the support surface to minimize operating forces and to avoid wearing of the insulator. Such wear could detract from the proper alignment of the insulator. Additionally, for outdoor use, the harsh environment makes it impractical to lubricate the surfaces. Thus, it is desirable to utilize a bearing, which may also be referred to as a bushing. While a metallic bearing may be utilized, polymeric materials offer lower frictional characteristics and no corrosion effects. However,, if a bearing of polymeric material is utilized, sufficient voltage may be developed across the bearing such that the resulting leakage currents and capacitive charging currents can cause tracking across and/or deterioration of the bearing.

SUMMARY OF THE INVENTION

Accordingly, it is a principal object of the present invention to provide a non-metallic bearing of suitable electrical conductivity for a rotatable support insulator to permit the flow of leakage current and capacitive charging current through the bearing, thus avoiding the buildup of sufficient voltage across the bearing that could cause deterioration of or tracking across the bearing.

This and other objects of the present invention are efficiently provided by a durable polymeric bearing for a rotatable support insulator. The bearing is of sufficient conductivity to permit the flow of leakage current and capacitive charging current through the bearing. Thus, tracking across and/or deterioration of the bearing is avoided since insufficient voltage is developed across the bearing to cause any deleterious effects.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
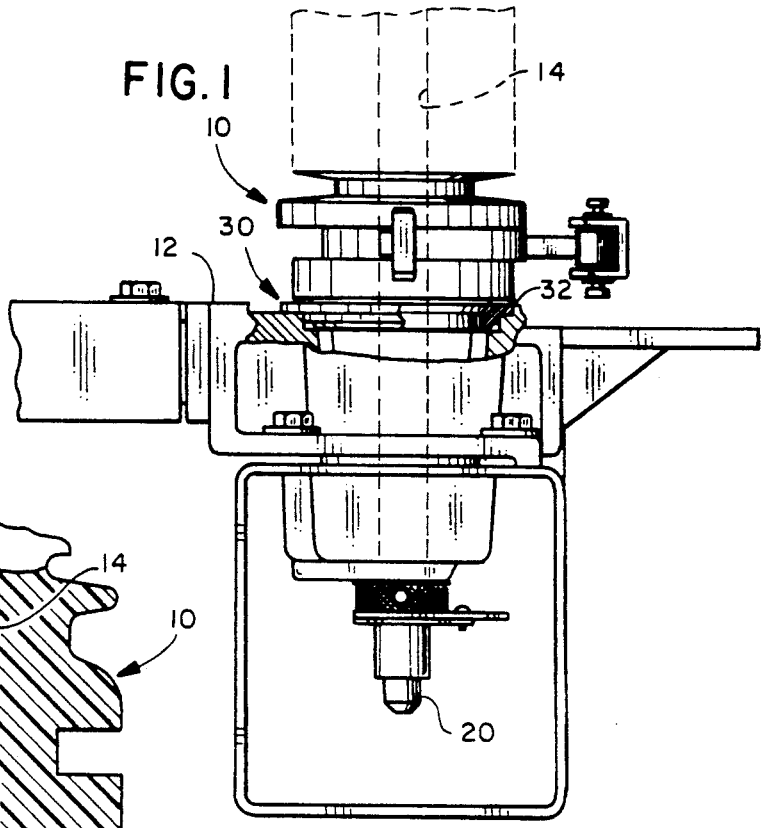
FIG. 1 is an elevational view partly in section of a rotatable support insulator rotatably supported with respect to a bearing support surface.
Figure 2:
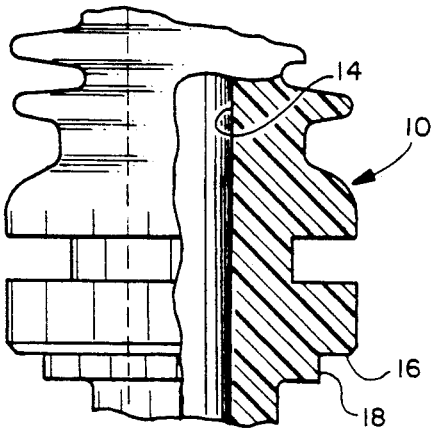
FIG. 2 is a partial view partly in section of the rotatable support insulator of FIG. 1.

Referring now to FIGS. 1 and 2, the stress-relieving arrangement of the present invention is illustrated for a support insulator 10. In the illustrative example of FIG. 1, the support insulator 10 is rotatably supported with respect to a support member 12. In a specific configuration, the support insulator 10 includes and defines a vertical upstanding section of a rotatable interrupter switch, the support insulator 10 being rotatable to provide a disconnect function. Reference may be made to copending U.S. application Ser. No. 07/331,216 filed in the names of Rogers et al on Mar. 30, 1989, now U.S. Pat. No. 4,983,792 for a more detailed discussion of the switch.

Figure 3:
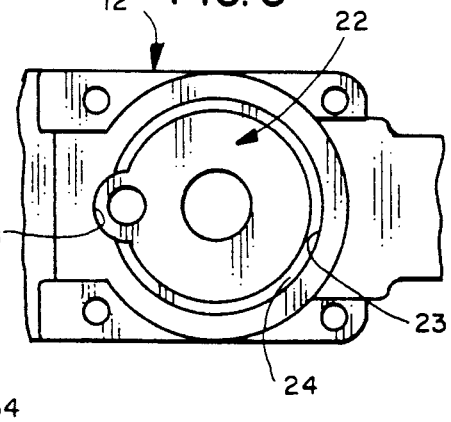
FIG. 3 is a plan view of the bearing support surface of FIG. 1.

In the illustrative example of FIG. 1, the support insulator 10 is molded from a polymeric compound, for example, cycloaliphatic resin. Considering additional illustrative features of the support insulator 10, in FIG. 1 the support insulator 10 is molded to define a bore 14 and various external characteristics including bearing surfaces at the lower end thereof. Specifically, as best seen in FIG. 2, a circumferential bearing surface 16 and a shoulder 18 are defined. In the illustrative arrangement, an operating rod 20 is disposed through the bore 14 for operation of an interrupter linkage (not shown). Referring now additionally to FIG. 3, the support mounting 12 includes a receiving arrangement including a circular opening 22 to receive the insulator. The receiving arrangement also includes a shoulder or necked-down portion 23 and a rim 24.

For outdoor use with harsh environments, there is no practical way to lubricate the interface of the support insulator 10 and the support mounting 12. Thus, an appropriate bearing surface (i.e., low frictional characteristics) is desirable between the support mounting 12 and the support insulator 10 to minimize operating effort and to ensure against deleterious wearing of the polymeric compound at the bearing surfaces 16 and 18. If a suitable bearing surface is not provided, the wear could detract from the proper alignment of the support insulator 10.

The top of the support insulator 10 id connected to a conductor at a first potential and the support mounting 12 is maintained at a second potential. If a non-metallic bearing 30 is provided between the support insulator 10 and the support mounting 12, sufficient voltage may be developed cross the bearing 30 to cause tracking across and/or deterioration of the bearing 30.

Figure 4:
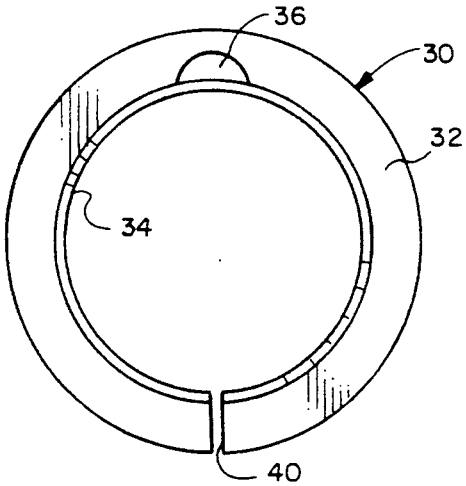
FIG. 4 is a plan view of a conductive bearing ring utilized in the stress-relieving arrangement of the present invention of FIG. 1.
Figure 5:
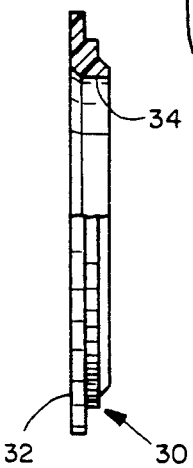
FIG. 5 is a left side elevational view partly in section of the conductive bearing ring of FIG. 3.

In accordance with important aspects of the present invention and with additional reference to FIGS. 4 and 5, a non-metallic conductive bearing 30 is provided within the support mounting 12 to cooperate with the bearing surfaces 16,18 of the support insulator 10. The bearing 30 (which may also be referred to as a bushing) includes a circumferential bearing surface 32 in the shape of an annular disk and a sleeve (cylindrical) bearing surface 34 for appropriate engagement with the respective bearing surfaces 16,18 of the support insulator 10. The bearing 30 also includes a curved projection 36 on the outer periphery of the sleeve portion 34 to cooperate with a mating receiving notch 38 formed into the inner periphery of the opening 22 of the support mounting 12. The notch 38 and projection 36 locate and affix the conductive bearing ring 30 within the support mounting 12 to ensure that there is no relative rotation between the support mounting 12 and the conductive bearing ring 30. Thus, relative rotation occurs as desired between the bearing surfaces 16,18 of the support insulator 10 and the bearing 30.

The bearing 30 is suitably dimensioned along with the opening 22, the portion 23, and the rim 24 of the support mounting 12 for desirable mating relationships. Also in a preferred embodiment, the bearing 30 includes a gap 40 so as to define a split-ring configuration. This configuration facilitates the appropriate affixing of the bearing 30 within the support mounting 12 and liberalizes the dimensional tolerances for the interfitting portions of the bearing 30 and the support mounting 12.

With the presence of a bearing 30 of suitable conductivity, leakage current and capacitive charging current are permitted to flow through the bearing 30 to the support mounting 12. Thus, insufficient voltage is developed across the bearing 30 to cause any deleterious effects.

While the term conductive is utilized to describe the bearing 30, it should be realized that conductivity on the order of metals is not required. The degree of conductivity is determined by the particular components and operating voltages. Thus, the bearing 30 is of suitable predetermined conductivity to avoid deleterious effects. In a specific example for a switch rated at 15 kV, the bearing 30 is suitably fabricated from a high-density polyethylene and is fiber-filled with carbon fibers to achieve a volume resistivity on the order of approximately 1,000 ohm-cm (per ASTM D257). A suitable material from which the bearing 30 may be fabricated is available from the RTP Co. of Winona, Minn., under the designation ESD-C-780.

While there have been illustrated and described various embodiments of the present invention, it will be apparent that various changes and modifications will occur to those skilled in the art. Additionally, the foregoing is intended to be illustrative and not to be interpreted in any limiting sense. Accordingly, it is intended in the appended claims to cover all such changes and modifications that fall within the true spirit and scope of the present invention.

What is claimed and desired to be secured by Letters Patent of the United States is:

1. In high-voltage apparatus, the combination of:

an insulator being maintained at a first potential at a predetermined point thereof;

a conductive support mounting being maintained at a second potential; and non-metallic means carried by and in engagement with said conductive support mounting for engagement with and for supporting said insulator, said non-metallic means being a bearing member of predetermined electrical conductivity so as to define a sufficiently conductive path from said insulator to said conductive support mounting to permit the flow of leakage current and capacitive charging current through said bearing member such that the buildup of voltage across said bearing member that could cause deterioration of or tracking across said bearing member is avoided.

2. The combination of claim 1 wherein said bearing member includes a circumferential bearing surface defining an annular disk.

3. The combination of claim 2 wherein said bearing member further comprises a cylindrical bearing surface disposed generally at a right angle to said circumferential bearing surface.

4. The combination of claim 3 wherein said insulator include a circumferential bearing surface for cooperation with said circumferential bearing surface of said bearing ring.

5. The combination of claim 4 wherein said insulator further include a cylindrical bearing surface for cooperation with said cylindrical bearing surface of said bearing member.

6. The combination of claim 1 wherein said bearing member is fabricated from carbon-fiber filled high-density polyethylene.

7. The combination of claim 1 wherein said bearing member has a volume resistivity on the order of 1,000 ohm-cm.

8. The combination of claim 1 wherein said bearing member and said conductive support mounting include cooperating means for preventing movement of said bearing member with respect to said conductive support mounting.

9. The combination of claim 1 wherein said bearing member comprises a ring having a gap so as to define a split ring configuration.

10. In high-voltage apparatus, the combination of: 'an insulator;

a conductive support mounting; and non-metallic means carried by and in engagement with said conductive support mounting for engagement with and for supporting said insulator, said non-metallic means being a bearing member of predetermined electrical conductivity so as to define a sufficiently conductive path from said insulator to said conductive support mounting to permit the flow of leakage current and capacitive charging current through said bearing member and to maintain the electrical potential across said bearing member below a predetermined potential with respect to said insulator having a first potential at a predetermined point of said insulator and said conductive support member being at a second potential thereby avoiding deterioration of or tracking across said bearing member.

* * * * *